US006165080A

United States Patent [19]

Salisbury

[11] Patent Number: 6,165,080

[45] Date of Patent: Dec. 26, 2000

[54] GOLF CLUB AIR ASSIST DRIVER

[76] Inventor: Richard M. Salisbury, P.O. Box 1161, Bolton Landing, N.Y. 12814

[21] Appl. No.: 09/173,120

[22] Filed: Oct. 15, 1998

[51] Int. Cl.[7] ..... A63B 53/04

[52] U.S. Cl. ..... 473/327

[58] Field of Search ..... 473/324, 327, 473/328, 228; D21/733, 734, 735

[56] References Cited

U.S. PATENT DOCUMENTS

| | | |
|---|---|---|
| 2,550,846 | 5/1951 | Milligan . |
| 3,003,768 | 10/1961 | Clements . |
| 3,468,544 | 9/1969 | Antonious . |
| 3,997,170 | 12/1976 | Goldberg . |
| 4,431,192 | 2/1984 | Stuff, Jr. . |
| 4,930,783 | 6/1990 | Antonious . |
| 5,054,784 | 10/1991 | Collins . |
| 5,158,296 | 10/1992 | Lee . |
| 5,240,252 | 8/1993 | Schmidt et al. . |
| 5,271,622 | 12/1993 | Rogerson . |
| 5,524,890 | 6/1996 | Kim . |
| 5,529,303 | 6/1996 | Chen . |
| 5,674,136 | 10/1997 | Gorse . |
| 5,681,227 | 10/1997 | Sayrizi . |
| 5,695,409 | 12/1997 | Jackson . |

*Primary Examiner*—Sebastiano Passaniti
*Attorney, Agent, or Firm*—Schmeiser, Olsen & Watts

[57] ABSTRACT

A low drag golf club head that provides greater club head speed, increased driving distance, and increased directional accuracy. An air inlet slot located on the front striking face of the golf club head channels air through an internal venturi shaped passage to an air outlet slot located in the wake region at the rear of the golf club head. Drag losses are minimized within the venturi shaped air passage and the air passage is additionally configured to provide a directionally oriented outlet air jet that operates to square the front striking face of the golf club head at and through impact, thereby reducing slices and hooks.

14 Claims, 3 Drawing Sheets

FIG. 1
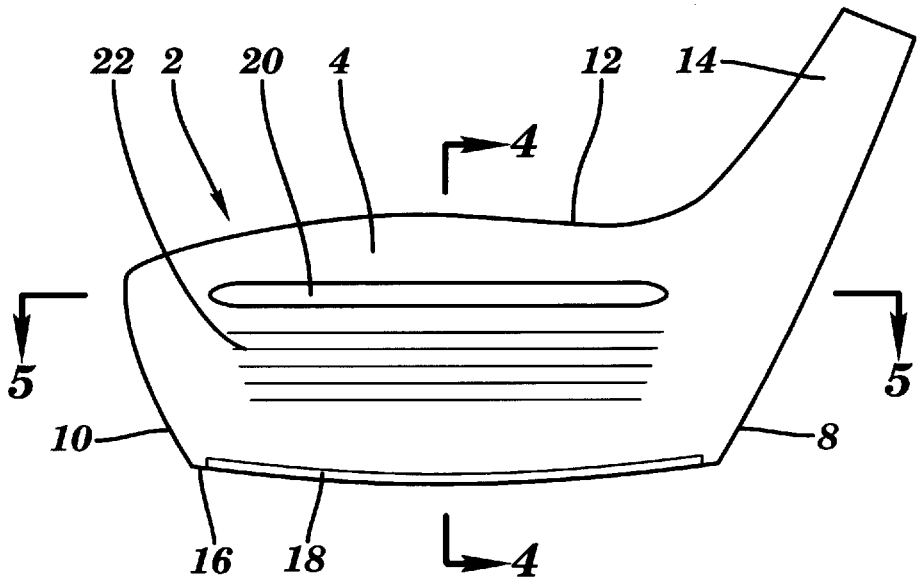
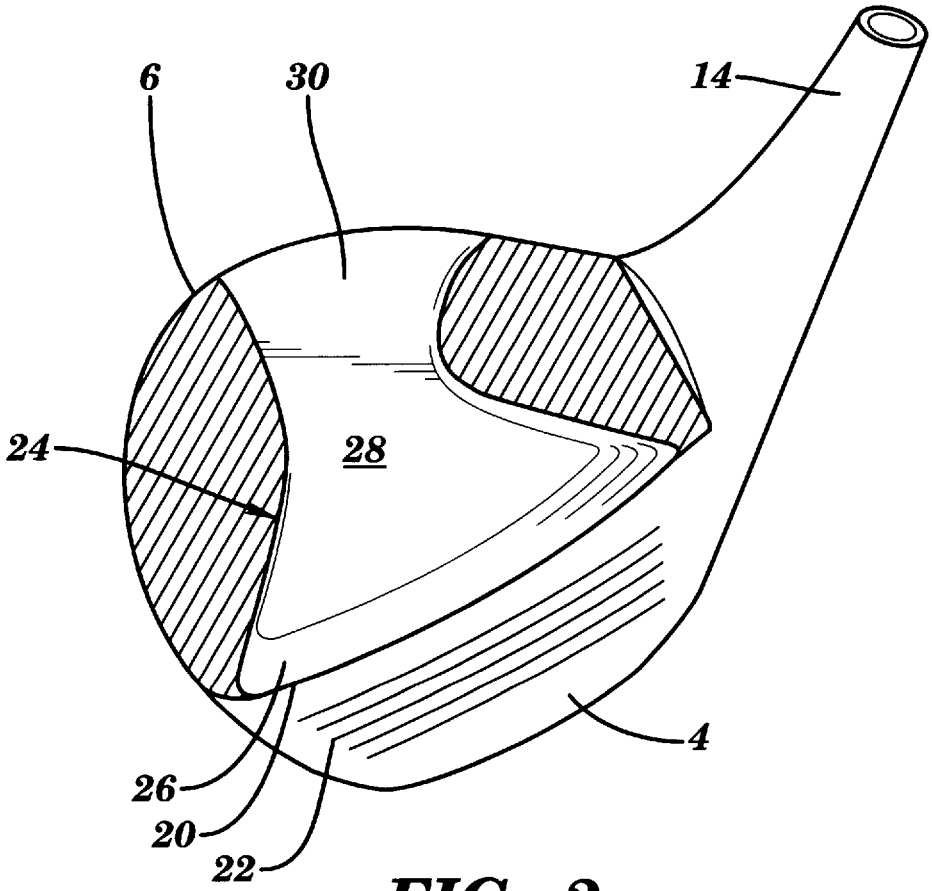
FIG. 2

GOLF CLUB AIR ASSIST DRIVER

FIELD OF THE INVENTION

The present invention relates generally to golf clubs, and, more particularly, to a golf club head having improved aerodynamic performance enabling a golfer to generate greater club head speed during a swing. In addition, the golf club head of the present invention is configured to help correct an outside to inside or inside to outside swing path.

BACKGROUND OF THE INVENTION

Many attempts have been made to reduce air drag on the head of a golf club to provide greater club head speed and longer driving distance. One technique involves forming holes or passages through the club head to allow air to flow through the club head during a swing. In theory, the use of such holes or passages should reduce the area of low pressure created at the back of the club head during a swing, thereby reducing the drag force against the club head during a swing. Unfortunately, however, due to the inadequacies of previous designs, the turbulence generated within the holes or passages in the club head actually causes an increase in drag, thereby offsetting any drag reduction provided through the use the holes or passages in the first place.

SUMMARY OF THE INVENTION

The present invention provides a low drag golf club head that provides greater club head speed, increased driving distance, and increased directional accuracy.

Drag reduction is achieved in the present invention by using an air inlet slot located on the front striking face of the golf club head to channel high pressure air through an internal air passage to an air outlet slot located in the low pressure wake region at the rear of the golf club head. The air passage is additionally configured to provide a directionally oriented outlet air jet that operates to square the front striking face of the golf club head at and through impact, thereby reducing slices and hooks.

According to a preferred embodiment of the invention, the golf club head comprises a front striking face, a rear side opposite the front striking face, a heel portion for connection to a golf club shaft, a toe portion opposite the heel portion, a top surface extending between the front striking face and the rear side, and a bottom surface with a sole plate opposite the top surface. An internal air passage is provided connecting the front striking face with the rear side of the golf club head. The internal air passage includes an air inlet slot formed in the front striking face, an air outlet slot formed in the rear side of the golf club head, and a venturi shaped air passage extending through the body of the golf club head between the air inlet slot and the air outlet slot.

The air inlet slot is positioned substantially parallel to the top surface of the golf club head, and is substantially as wide as the front striking face. Since separated flow drag is generated across the entire width of the top surface of the golf club head during a swing, the air inlet slot is preferably formed as wide as possible across the front striking face to divert the air before it reaches the top surface of the golf club head. To position the air inlet slot in a high pressure region, the air inlet slot is preferably formed in the upper third portion of the front striking face. During a swing, air flows from the high pressure region located at the air inlet slot, through the venturi shaped air passage, exiting into the low pressure region located at and behind the air outlet slot formed in the rear side of the golf club head.

In the present invention, drag losses have been minimized within the venturi shaped air passage formed through the golf club head. For example, since the golf club head travels through an arc during a swing, the air direction relative to the front striking face is not perpendicular, but is pointed slightly downward. To match this downward flow direction, the venturi shaped air passage contains a downward sloping entrance ramp located adjacent the bottom of the air inlet slot. After flowing into the air inlet slot and over the downward sloping entrance ramp, air next enters the venturi shaped air passage which serves several important functions.

In the venturi shaped air passage, the air velocity is increased while still maintaining laminar flow. Laminar flow is important because the drag produced with laminar flow is much less than the drag produced with turbulent flow. Further, the venturi shaped air passage provides an efficient means to control the amount of air flow through the passage.

Another function of the venturi shaped air passage is to change the direction of the air such that the outlet air jet can be directed into the low pressure, separated flow region which exists behind the golf club head during a swing. The outlet air jet fills in the separated flow region, reducing the air drag on the golf club head, and rotates the golf club head to square the front striking face at and through impact.

Since the golf club head is offset from the golf club shaft, forces acting on the golf club head during a swing will cause a moment about the golf club shaft. When swinging a right handed golf club, for example, the air drag and the force generated when striking the ball cause a clockwise moment to be applied to the golf club shaft. By locating the air outlet slot toward the shaft (i.e., hosel) end of the golf club head, the outlet air jet generated during a swing is directed toward the shaft end of the golf club head causing a counterclockwise moment to be applied to the golf club shaft. In addition, the air outlet jet generates a force which causes the golf club head to move in a direction away from the golf club shaft. This movement can help correct an outside to inside swing path. For a left handed golf club head, the opposite of the above would apply.

By locating the air outlet slot toward the toe end of the golf club head, the outlet air jet generated during a swing is directed away from the shaft end of the golf club head causing a counterclockwise moment to be applied to the golf club shaft. In addition, the air outlet jet generates a force which causes the golf club head to move in a direction toward the golf club shaft. This movement can help correct an inside to outside swing path. Again, for a left handed golf club head, the opposite of the above would apply.

Thus, the improved golf club head in accordance with the present invention is capable of generating greater club head speed during a swing due to decreased drag, as well as providing better club head control by counteracting the twisting moment on the golf club shaft during a swing. Further, the improved golf club head of the present invention can be configured to provide an a inward or outward force to help correct an inside to outside or outside to inside swing path.

BRIEF DESCRIPTION OF THE DRAWINGS

The features of the present invention will best be understood from a detailed description of the invention and a preferred embodiment thereof selected for the purposes of illustration and shown in the accompanying drawings in which:

FIG. 1 is a front elevational view of a golf club head in accordance with a preferred embodiment of the present invention;

FIG. 2 is a perspective cut-away view of the golf club head of FIG. 1, illustrating the air passage of the present invention;

DETAILED DESCRIPTION OF THE INVENTION

Figure 3:
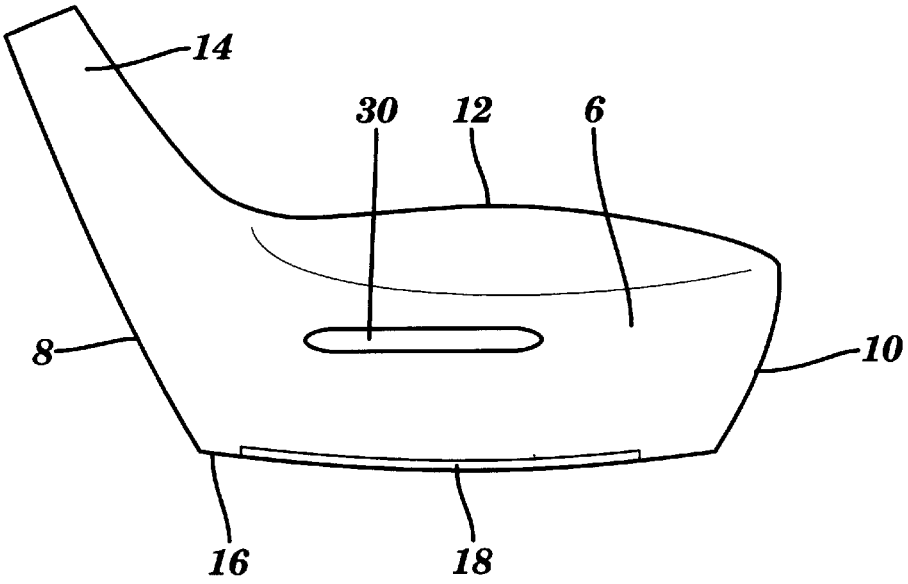
FIG. 3 is a rear elevational view of the golf club head of FIG. 1.

The features and advantages of the present invention are illustrated in detail in the accompanying drawings, wherein like reference numerals refer to like elements throughout the drawings.

Referring to FIGS. 1, 2 and 3, there is illustrated a golf club head, generally designated as 2, in accordance with a first, preferred embodiment of the present invention. The golf club head 2 comprises a front striking face 4, a rear side 6, a heel portion 8, a toe portion 10, a top surface 12, a hosel 14, and a bottom surface 16 covered with a sole plate 18. The golf club head 2 may be formed of wood, metal, or other suitable material used in the construction of golf club heads.

The front striking face 4 includes a plurality of horizontally extending grooves 22 which run from the toe portion 10 toward the heel portion 8 of the golf club head 2. The front striking face 4 additionally includes an air inlet slot 20 formed substantially parallel to the top surface 12 and extending substantially as wide as the front striking face 4. The rear side 6 of the golf club head 2 includes an air outlet slot 30. An air passage 24 extends through the golf club head 2 between the air inlet slot 20 and the air outlet slot 30. To maximize drag reduction, the air inlet slot 20 is preferably located in the upper third of the front striking face 4, while the air outlet slot 30 is located in the middle to top portion of the rear side 6.

Figure 4:
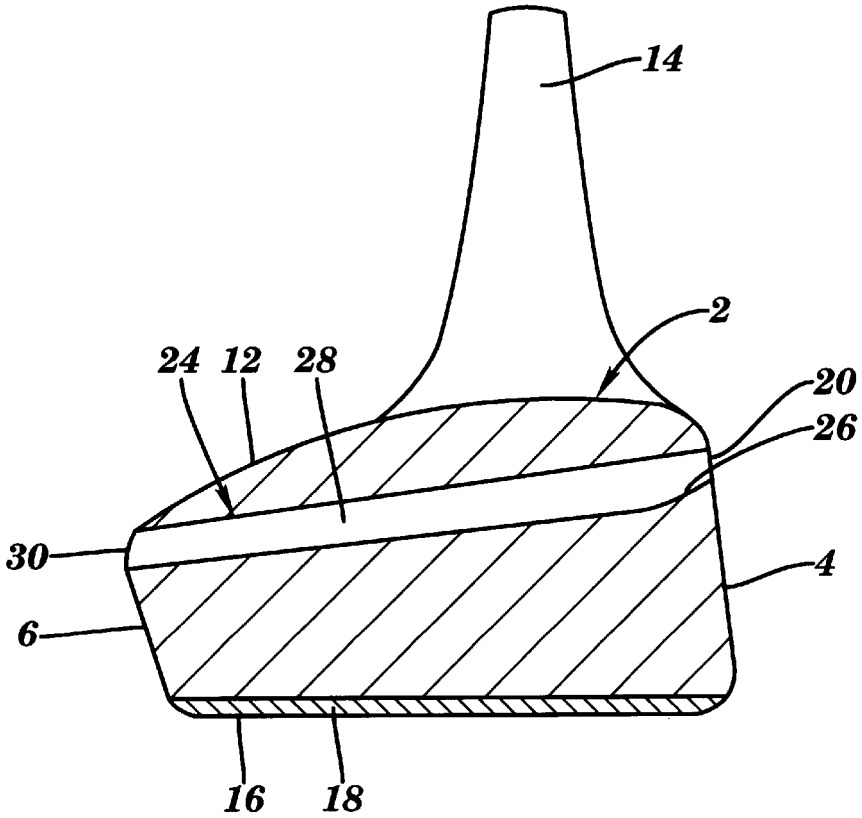
FIG. 4 is a cross-sectional view taken along line 4—4 of FIG. 1.

FIG. 4 is a cross-sectional view taken along line 4—4 of FIG. 1 illustrating the configuration of the air passage 24. The air passage 24 includes the air inlet slot 20, the air outlet slot 30, and a venturi section 28. During a swing, air enters the golf club head 2 through the air inlet slot 20, travels through the venturi section 28, and exits the rear side 8 of the golf club head 2 through the air outlet slot 30.

Since the golf club head 2 travels through an arc during a swing, the air direction relative to the front striking face 4 is not perpendicular, but is pointed slightly downward. To match this downward flow direction, thereby reducing air turbulence within the air passage 24, the air passage 24 contains a downward sloping entrance ramp 26, formed adjacent the air inlet slot 20, that has a 15° to 30° downward slope angle as measured relative to the top surface of the air passage 24.

Figure 5:
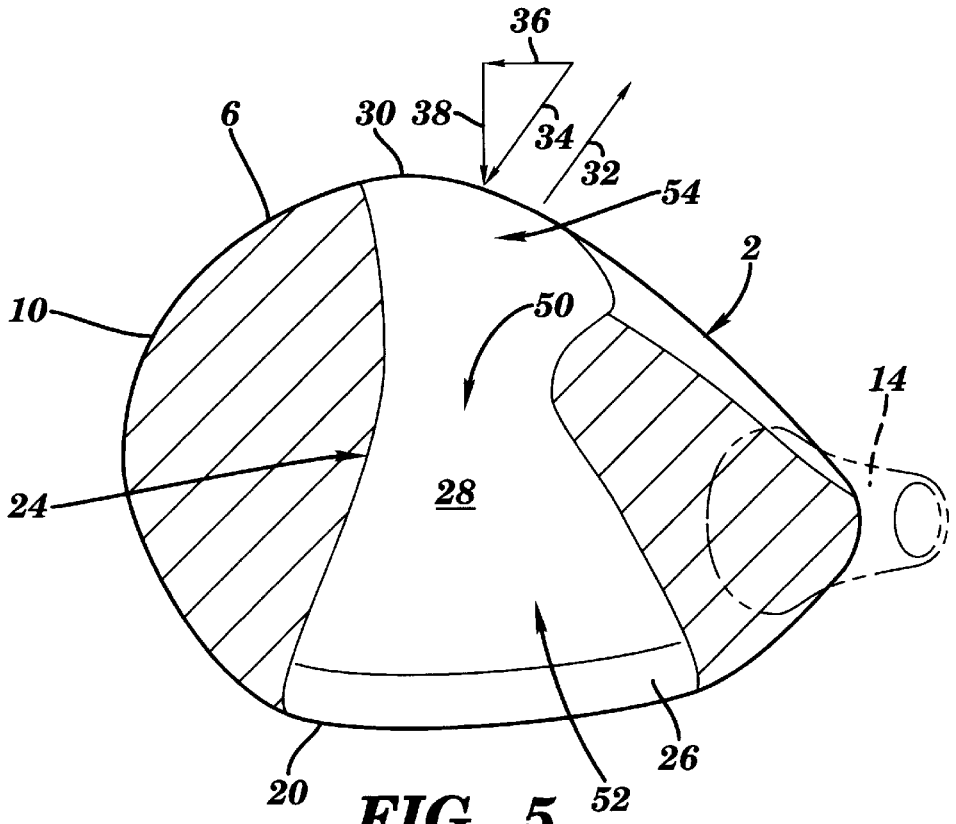
FIG. 5 is a cross-sectional view taken along line 5—5 of FIG. 1 illustrating a first embodiment of the air passage.

FIG. 5 is a cross-sectional view taken along line 5—5 of FIG. 1 illustrating the configuration of the air passage 24. Air enters the air passage 24 through the air inlet slot 20 at a first velocity, accelerates as it passes through the venturi section 28, and exits at the air outlet slot 30 at a second, higher velocity.

The venturi section 28 generally comprises a constricted portion 50 having a minimum cross-sectional area, a contracting portion 52 having a contracting cross-sectional area extending from the air inlet slot 20 to the constricted portion 50, and an expanding portion 54 extending from the constricted portion 50 to the air outlet slot 30. The air velocity increases as the air flows through the contracting portion 52, and reaches a maximum velocity as it passes through the constricted portion 50, thereby forming an air jet. The air jet exits the venturi section 28 through the expanding portion 54 and the air outlet slot 30. The flow direction of the air jet is established by the orientation of the expanding region 54 and the location of the air outlet slot 30.

The constricted portion 50 of the venturi section 28 preferably has a width that is approximately 30% to 45% of the width of the air inlet slot 20, and has a cross-sectional area approximately 45% to 55% of the cross-sectional area of the air inlet slot 20. Furthermore, the width of the air outlet slot 30 is preferably about 45% to 60% of the width of the air inlet slot 20, while the cross-sectional area of the air outlet slot 30 is about 75% to 85% of the cross-sectional area of the air inlet slot 20. It should be noted, however, that the specific dimensions and configuration of the air inlet slot 20, air outlet slot 30, and venturi section 28 are variable depending on many factors including, for example, the material used in the construction of the golf club head, the size and shape of the golf club head, the desired strength and/or flow direction of the outlet air jet, etc. Such variations are intended to fall within the scope of the present invention as claimed.

In the preferred embodiment of the present invention, the outlet air jet exiting through the air outlet slot 30 during a swing generally travels in a direction denoted by directional arrow 32 in FIG. 5. Specifically, the directional arrow 32 is oriented at an acute angle relative to the front striking face 4 of the golf club head and is directed toward the hosel 14. As shown in FIG. 5, the reaction force 34 acting on the golf club head 2 in response to the outlet air jet is in a direction opposite to directional arrow 32. This reaction force 34 can be split into two components, including a force vector 36 parallel to the front striking face 4 and a force vector 38 perpendicular to the front striking face 4. Force vector 38 causes a counterclockwise moment about the hosel 14 which counteracts the clockwise moment applied to the club shaft by the air drag and the force generated when striking a golf ball, thereby helping to square the front striking face 4 at impact. Force vector 36 causes the golf club head 2 to move in a direction away from the golf club shaft, thereby helping to correct an outside to inside swing path.

Figure 6:
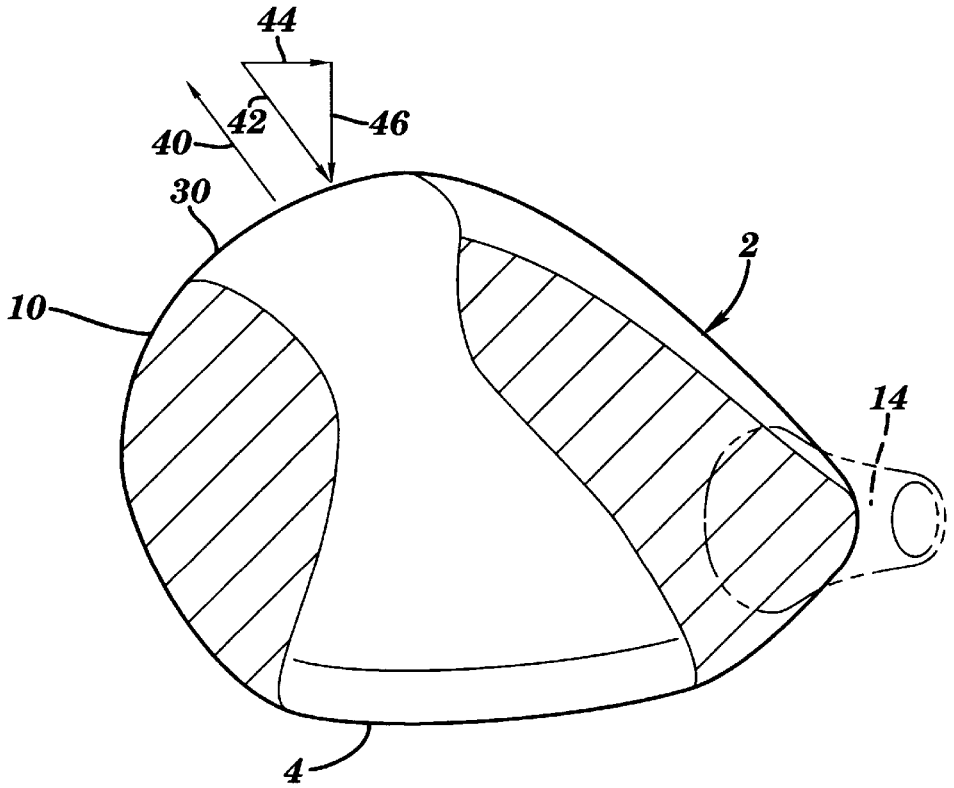
FIG. 6 is a cross-sectional view illustrating another embodiment of the air passage.

FIG. 6 illustrates another embodiment of the golf club head 2 of the present invention, wherein the air outlet slot 30 is located toward the toe portion 10 of the golf club head 2. In this embodiment, the outlet air jet exiting through the air outlet slot 30 during a swing generally travels in a direction denoted by directional arrow 40. As shown, directional arrow 40 is oriented toward the toe portion 10 of the golf club head 2, resulting in a reaction force 42 acting on the golf club head 2 in a direction opposite to directional arrow 40. This reaction force 42 can be split into two components, including a force vector 44 parallel to the front striking face 4, and a force vector 46 perpendicular to the front striking face 4. Force vector 46 causes a counterclockwise moment about the hosel 14 which counteracts the clockwise moment applied to the golf club shaft by the air drag and the force generated when striking a golf ball, thereby helping to square the front striking face 4 at impact. Force vector 44 causes the golf club head 2 to move in a direction toward the golf club shaft, thereby helping to correct an inside to outside swing path.

If no inside to outside or outside to inside swing correction is desired, again referring to FIG. 5, the air outlet slot 30 can be located on the rear side 2 of the golf club head 2 such that the force vector 36 becomes zero. In this case, the reaction force 34 would be perpendicular to the front striking face 4 of the golf club head 2 and would cause a counterclockwise moment about the hosel 14 that would help counteract the clockwise moment generated by the air drag and the force generated when striking a golf ball.

The foregoing description of the present invention has been presented for purposes of illustration and description. It is not intended to be exhaustive or to limit the invention to the precise form disclosed, and many modifications and variations are possible in light of the above teaching. Such modifications and variations that may be apparent to a person skilled in the art are intended to be included within the scope of this invention as defined by the accompanying claims.

I claim:

1. A golf club head comprising:

a front striking face;

a rear side opposite the front striking face;

a top surface extending between the front striking face and the rear side;

an air inlet slot on the front striking face positioned substantially parallel to the top surface of the golf club head;

an air outlet slot on the rear side positioned substantially parallel to the top surface of the golf club head;

an internal air passage connecting the air inlet slot with the air outlet slot, the air passage including a venturi section comprising a constricted portion, a contracting portion extending from the air inlet slot to the constricted portion, and an expanding portion extending from the constricted portion to the air outlet slot, for generating an outlet air jet, the outlet air jet flowing out of the golf club head through the air outlet slot moving the golf club head in a predetermined direction parallel to the air outlet slot; and a lower surface of the contracting portion including a downward sloping entrance ramp extending from the air inlet slot on the front inlet face into the air passage.

2. The golf club head according to claim 1, wherein a width of the constricted portion of the venturi section is less than a width of the air inlet slot and a width of the air outlet slot.

3. The golf club head according to claim 1, wherein the outlet air jet reduces air drag on the golf club head during a swing.

4. The golf club head according to claim 1, wherein the outlet air jet generates a force on the golf club head that squares the front striking face of the golf club head during a swing.

5. The golf club head according to claim 1, wherein the outlet air jet generates a force on the golf club head that corrects an inside to outside or outside to inside swing path.

6. The golf club head according to claim 1, wherein the air outlet slot is positioned to direct an outlet air jet toward a shaft end of the golf club head.

7. The golf club head of claim 1, wherein the air outlet slot is positioned to direct an air outlet jet toward a toe portion of the golf club head.

8. The golf club head of claim 1, wherein the air outlet slot is positioned substantially parallel to the front striking face.

9. The golf club head according to claim 1, wherein the air inlet slot is located in an upper third portion of the front striking face.

10. The golf club head according to claim 1, wherein the air inlet slot has a width substantially as wide as the front striking face.

11. The golf club head according to claim 1, wherein the air outlet slot is located adjacent a top portion of the rear side.

12. The golf club head according to claim 1, wherein a cross-sectional area of the air outlet slot is less than a cross-sectional area of the air inlet slot.

13. The golf club head according to claim 1, wherein a width of the air outlet slot is smaller than a width of the air inlet slot.

14. An apparatus comprising:

a golf club head, the golf club head including an internal system for generating an outlet air jet for reducing air drag on the golf club head during a swing, for generating a force on the golf club head that presses forward against a rear side of the golf club head during a swing, and for generating a force on the golf club head that pushes the golf club head in a direction perpendicular to a swing path for correcting an inside to outside or outside to inside swing path, wherein the system for generating the outlet air jet further includes:

an air inlet slot located on a front striking face of the golf club head;

an air outlet slot located on a rear side of the golf club head;

an internal air passage connecting the air inlet slot with the air outlet slot, the air passage including a venturi section comprising a constricted portion, a contracting portion extending from the air inlet slot to the constricted portion, and an expanding portion extending from the constricted portion to the air outlet slot; and a lower surface of the contracting portion including a downward sloping entrance ramp extending from the air inlet slot on the front striking face into the air passage.

* * * * *